US005275242A

United States Patent [19]

Payne

[11] Patent Number: 5,275,242

[45] Date of Patent: Jan. 4, 1994

[54] REPOSITIONED RUNNING METHOD FOR WELL TUBULARS

[75] Inventor: David J. Payne, Camarillo, Calif.

[73] Assignee: Union Oil Company of California, Los Angeles, Calif.

[21] Appl. No.: 938,443

[22] Filed: Aug. 31, 1992

[51] Int. Cl.[5] ..... E21B 47/00

[52] U.S. Cl. ..... 166/380

[58] Field of Search ..... 166/378-; 175/61, 62, 73

[56] References Cited

U.S. PATENT DOCUMENTS

| | | | |
|---|---|---|---|
| 4,570,709 | 2/1986 | Wittrish | 166/378 X |
| 4,877,089 | 10/1989 | Burns | 166/378 X |
| 4,949,791 | 8/1990 | Hopmann et al. | 166/380 X |
| 5,101,906 | 4/1992 | Carlin et al. | 166/380 |

*Primary Examiner*—Thuy M. Bui
*Attorney, Agent, or Firm*—Gregory F. Wirzbicki; William O. Jacobson

[57] ABSTRACT

Weighted segments are repositioned during the running of tubulars into a deviated portion of the well. One method of repositioning adds separate weights to the top of a tubular string, runs the separate weight partially "down" the well, removes the weight downhole from the tubular string, and repositions and attaches the weight to an uphole portion of the tubular string prior to continuing the running operation. Another method partially runs a first portion of the tubulars detachably connected to heavy weight drill string, detaches and repositions the heavy drill string leaving the first tubular portion downhole, runs a second tubular portion downhole until it contact the first portion using the repositioned heavy drill string to assist in running, attaches the first tubular portion to the second tubular portion, and continues running the reattached assembly downhole. Repositioning can be accomplished by a detachable pipe string connector, such as a snap latch, or a retrievable tool attached to the tubulars, such as a retrievable bridge plug. The method extends the horizontal distance the tubulars can be run without rotation, additional force, or trapping a buoyant fluid.

21 Claims, 3 Drawing Sheets

REPOSITIONED RUNNING METHOD FOR WELL TUBULARS

FIELD OF THE INVENTION

This invention relates to well drilling and completion devices and processes. More specifically, the invention relates to a method of running a liner or casing string into an extended reach wellbore.

BACKGROUND OF THE INVENTION

Many subterranean well completions require a liner or casing string to be set in a portion of the wellbore. In some wells, such as wells drilled from platforms or "islands," an extended portion of the liner or casing string must be set in a deviated portion of the wellbore i.e., a wellbore portion at an inclined angle to the vertical. The inclined angle in these extended reach wells frequently approaches 90 degrees (from the vertical) and sometimes exceeds 90 degrees. The result is a well bottom laterally offset from the top of the well by a significant distance.

Current state-of-the-art allows drilling of well bores at almost any incline angle, but current well completion methods have experienced problems when setting casing or liner strings in long, highly deviated wells. When drilling, the drill string is typically rotated, thereby reducing drag forces which retard the drill string from sliding into the wellbore or borehole even in highly deviated wells. However, the configuration, diameter, and weight of casing and liner strings (which are typically larger and heavier than typical drill strings) may preclude rotation, e.g., the added weight and size of a liner string can generate significant drag forces and the torsional forces needed to overcome drag can be greater than the torsional strength force limits of the liner string. Torsional strength limitations can be especially severe for slotted liners.

The greater drag and lack of rotation in these wells may cause the casing or liner pipe string to become differentially stuck before reaching the setting depth. If sufficient additional force (up or down) cannot be applied, a stuck string may result in the effective loss of the well. Even if a stuck string is avoided, the forces needed to overcome the high drag may damage the pipe string.

In spite of these extended reach problems, wells having long, nearly horizontal well intervals may be required for fields having limited surface access. Even for fields where surface access is not a problem, long horizontal well sections may be economically desirable. Higher production rates from horizontal instead of vertical wells may be possible from zones where production of unwanted fluids develops from vertically adjacent beds in vertical wells, e.g., coning of water into an oil producing zone.

A flotation method of placing a liner or casing pipe string into a deviated, liquid filled hole is also known to reduce drag-related problems. This method is illustrated in U.S. Pat. Nos. 4,384,616; 4,986,361; and 5,117,915. However, this method requires the wellbore to be fluid filled and a means for trapping and releasing a less dense fluid within the casing or liner string.

Another method useful in short deviated wells is to attach a top weighted segment to the tubular string being run, e.g., using heavy weight drill string attached to the top of the string. The added top weight (in the upper vertical portion of the well) provides more force to drive or push the tubulars into the deviated portion of the well. However, for wells having a long, nearly horizontal portion, the top weight no longer provides added force to push the string once the weight enters the horizontal portion. In fact, the added weight in the horizontal portion only creates more drag. Thus, the top weight method has been generally limited to wells having only a short deviated portion.

SUMMARY OF THE INVENTION

Such drag and stuck string problems are avoided in the present invention by attaching a detachable weighting segment to the string in the near vertical portion of the well, running the weighted segment downhole to the deviated portion, detaching the weighted segment downhole, and repositioning/reattaching the weighted segment to the string in the near vertical portion. One method connects separate weights to the top of a tubular string, runs the separate weights partially "down" the well, disconnects the separate weights downhole, and repositions and reattaches the separate weights to the tubular string uphole. Another method runs a heavy top portion of the tubulars detachably connected to the remaining string portion, detaches the heavy portion leaving the remaining portion downhole, repositions and attaches the heavy string portion to the top of a second tubular portion, runs the tubular assembly downhole until it contacts the remaining portion downhole, attaches the portions downhole, and continues running the attached assembly downhole.

Like the prior method of running tubulars using top weights, the present invention uses mostly conventional tools, but does require a detachable and repositionable weighting means. This can be accomplished by a detachable heavy pipe string connector, such as a snap latch and/or a repositionable tool, such as a retrievable bridge plug.

The invention achieves the need for running tubulars into an extended reach well with mostly conventional equipment. The method extends the horizontal distance the tubulars can be run without rotation or trapping a buoyant fluid.

BRIEF DESCRIPTION OF THE DRAWINGS

In these Figures, it is to be understood that like reference numerals refer to like elements or features.

DETAILED DESCRIPTION OF THE INVENTION

Figure 1:
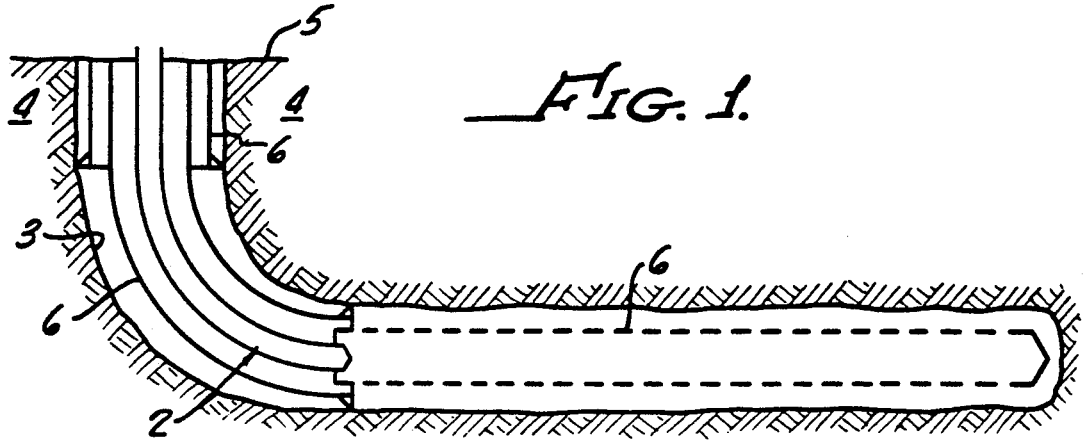
FIG. 1 shows a schematic cross-sectional view of first tubular portion being run into a well.

FIG. 1 shows a first tubular portion or section 2 being run into a wellbore 3 in a subterranean formation 4 below a ground surface 5. The first tubular portion 2 may be a pipe string which will make up a segment of a liner or casing string for the well after completion. As shown in FIG. 1, larger diameter casing strings 6 have been previously run and set into wellbore 3. The first tubular portion 2 is substantially within these previously run casing sections 6. The bottom-most previously run casing sections 6 is a slotted pipe string and is therefore shown dotted.

The first tubular portion 2 can be run a predetermined length into the wellbore. Determination of the length may be accomplished by predictive drag and buckling analysis methods. Alternatively, the first tubular portion may be run until an indicator weight (indicating the force needed to support the tubular portion 2 from the surface) reaches a level symptomatic of high drag conditions. The string can also be run until it becomes stuck.

Figure 2:
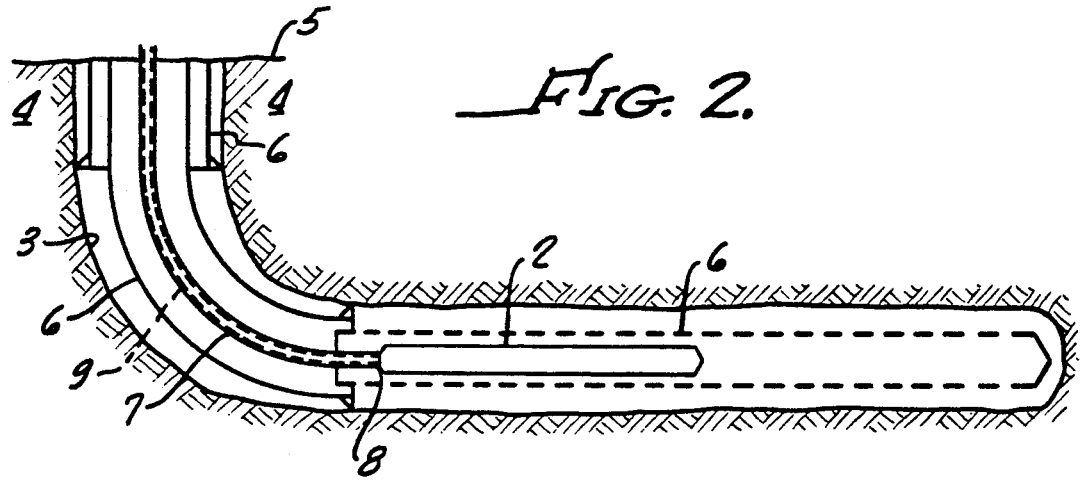
FIG. 2 shows a schematic cross-sectional view of the first tubular portion shown in FIG. 1 as it continues to be run with a drill pipe.

FIG. 2 is a schematic view of the well shown in FIG. 1 after a heavy weight drill pipe string 7 is releasably connected by a release tool or mechanism 8 to the first tubular portion 2 and the connected assembly has been run further into the well. A preferred example of a release tool 8 is a right-hand release snap-latch supplied by Baker Oil Tools, Inc. located in Ventura, California. An example of preferred drill pipe 7 is Hevi-Wate drill pipe supplied by H & H Oil Tools, Inc. located in Santa Paula, California. Although normal drill pipe weights ranging from about 13.75 pounds/foot to 20.00 pounds per foot (20.46 to 29.76 kg/meter) for a 4½ inch (11.43 cm) nominal diameter pipe can be used, heavier weight drill pipe is expected to be more typically used, preferably at least ranging from about 40 pounds per foot (59.52 kg/meter) to 45 pounds per foot (66.96 kg/meter ) for 4½ inch (11.43 cm) nominal diameter drill pipe. Even more preferably, heavier drill collars of at least 87 pounds per foot (129.46 kg/meter) are expected to be used Similarly for a larger diameter drill pipe size, heavier weight drill pipe is preferred ranging from about 48 pounds per foot (71.42 kg/meter) to 55 pounds per foot (81.84 kg/meter) for 5 inch (12.7 cm) nominal diameter drill pipe, more preferably heavy drill collars and/or pipe of at least 100 pounds per foot (148.8 kg/meter).

The drill pipe 7 and attached tubular portion 2 form a longer pipe string which is run still further into the wellbore to a second location in the well shown in FIG. 2. The added top weight of the drill pipe 7 in the near-vertical portion of the wellbore pushes the first tubular portion 2 outward towards the bottom of the wellbore 3. The second location where running is again halted can be predetermined (again using predictive drag and/or buckling, especially helical buckling analysis methods) or the string can be run until it is stuck, i.e., trial and error. Similarly, on-line indicator weight or other data can also be used to select the second location prior to getting stuck and without predetermination of the length.

An alternative or supplement to heavy weight drill pipe 7 is fluid weighting, e.g., filling the drill pipe 7 with a dense fluid and using the dense fluid as a weighting mechanism. This can be accomplished using seals or bladders to keep the dense fluid out of the first tubular portion 2. Avoiding the filling of tubular portion 2 with a dense fluid avoids adding weight (and drag) to the running process when the first tubular portion 2 is in a highly deviated portion of the well. Sealing can be accomplished by the release tool 8 including a means for unsealing to discharge the dense fluid when the final location is reached. A modified method partially fills drill pipe 7 with a dense fluid. The partial fill of drill pipe 7 can be accomplished by filling the annulus between an optional inner pipe 9 (option shown dotted) and the drill pipe 7. The inner pipe 9 also allows circulation of fluid through the first tubular portion 2 while running. The release tool 8 in this embodiment would seal only the annulus as well as releasably connect the drill pipe 7 to the first tubular portion 2.

The position of the heavy weight pipe string 7 in the second location shown in FIG. 2 has one end attached to the first tubular portion 2 within the horizontal segment of the well and the other end within or near the generally vertical, upper segment of the well. Thus, for a 300 foot (91.44 meters) vertical section, typically at least a 300 foot (91.44 meter) length of drill pipe 7 would be run, i.e, the lower end is expected to be within the build portion (shown as curving or transitioning between the vertical and horizontal portions) or within the horizontal portion of the well at the second location. As the weight of the drill pipe becomes less effective (as the lower end nears or enters the horizontal portion of the wellbore), the running would typically be halted at this second location.

Figure 3:
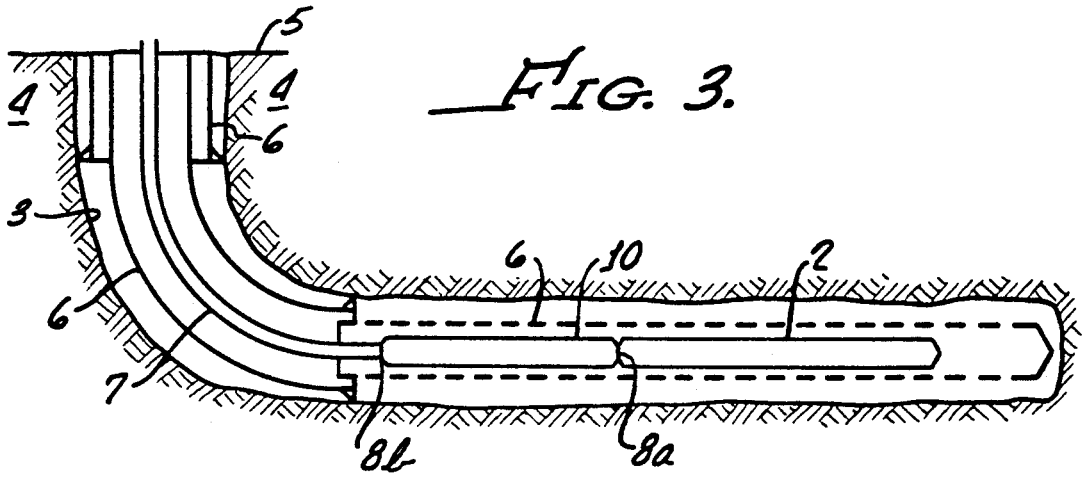
FIG. 3 shows a schematic cross-sectional view of the first tubular portion shown in FIG. 1 after the drill pipe has been repositioned and attached to a second tubular portion.

Once the running is halted at the second location, the release tool 8 (which may also serve as a weighting mechanism) disconnects the drill pipe 7 from the first tubular portion 2. The drill string 7 is then repositioned up well and attached to a second tubular portion (as shown in FIG. 3). The first tubular portion 2 along with an attached portion of the attachment mechanism 8, typically a female-type connector portion, remains in the well at the second location shown in FIG. 2 while the drill pipe 7 is removed. The remaining portion of the attachment mechanism 8, typically a male-type connector, is removed with the drill string 7.

FIG. 3 shows the second tubular portion 10 attached to the repositioned drill pipe 7 having run the first tubular portion 2 from the second location toward the bottom of the well. The repositioned drill pipe 7 may again be heavy weight, filled with a dense fluid, or otherwise provide additional weight again positioned in the upper, nearly vertical portion of the well. The repositioned weight again provides a driving force to run the first tubular portion 2 (and second tubular portion 10) further into the well.

The tubular portions are attached after the second tubular portion 10 contacts the first tubular portion 2 which remained in the well after disconnection from the drill pipe 7. Attachment of the tubular portions 2 and 10 uses the remaining female portion of the release tool 8 (shown in FIG. 2) attached to the first tubular portion 2 to engages a new mating portion, typically a male connector-type, attached to the second tubular portion 10 to form a tubular release tool 8*a* between the first and second tubular portions. Tubular release tool 8*a* may also not use any of the drill pipe/tubular release tool 8, using a separate on-off connector instead.

Similarly, the remaining male portion of the release tool 8 (shown in FIG. 2) attached to the drill pipe string 7 typically connects the repositioned drill pipe string 7. Attachment uses the female-type connector attached to the second tubular portion 10, forming a second tubular release tool 8*b*. Again, a separate on-off connector may also be used.

The two release tools 8*a* and 8*b* shown in FIG. 3 allow circulation of a fluid, such as a lubricating drilling mud, from the surface 5 through the drill pipe 7, second tubular portion 10, and first tubular portion 2. The fluid returns back up to the surface through the annulus between the existing casings 6 and the string composed of the drill pipe 7 and tubular portions 2 & 10. A means to circulate fluid, such as a drilling mud pump, is typically mounted at the surface to accomplish the fluid circulation.

After the first tubular portion 2 reaches a third location closer to the bottom of the well as shown in FIG. 3, the second tubular release tool 8*b* (between the drill pipe 7 and the second tubular portion 10) can actuated to release the drill pipe 7. The drill pipe 7 can then be repositioned nearer the top of the well and attached to a third tubular portion, similar to the procedure above discussed for repositioning ad attaching to the second tubular portion. The detaching, repositioning, adding of tubular portions, and reattaching can be still further repeated until the first tubular portion 2 reaches a final location desired within the well.

Once the final location is reached, the attached tubular string is set in the well, e.g., tubulars are attached to an existing casing 6 or cemented in place. The smaller diameter drill pipe 7 is also typically detached, e.g., by releasing release mechanism 8*b* or other release means, and withdrawn from the well. Withdrawal allows the full diameter of the tubulars to carry the flow of produced or injected fluids.

Figure 4:
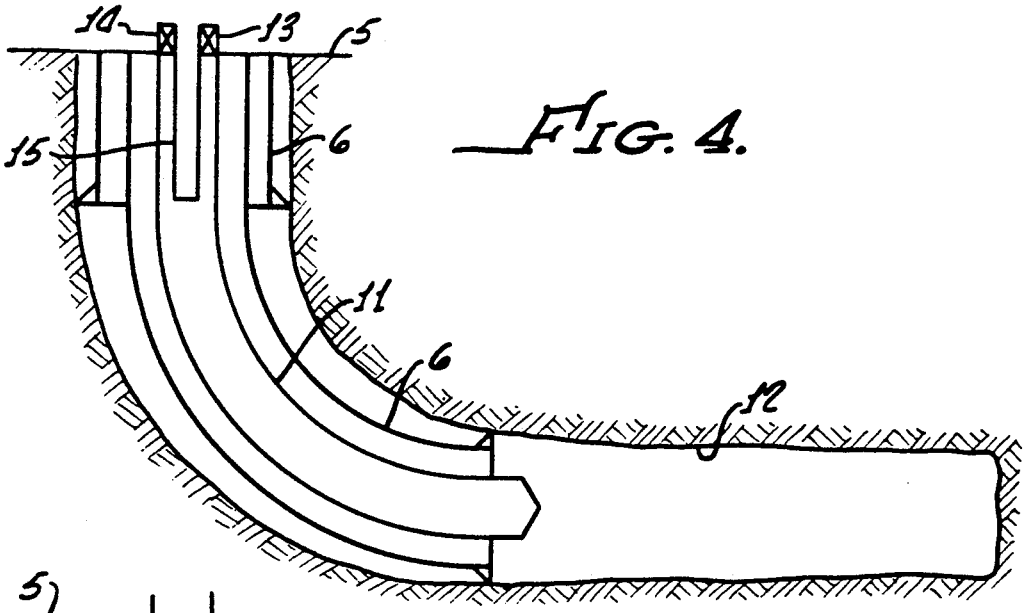
FIG. 4 shows a schematic cross-sectional side view of a tubular string (similar to that shown in FIG. 1) having a weighting implement attached.

FIG. 4 is a schematic view of a tubular string 11 as it is being run into a wellbore 12 similar to the tubular portion 2 being run into wellbore 3 shown in FIG. 1. Similar to FIG. 1, existing casing sections 6 have been previously set in the well, but the existing casing sections 6 in FIG. 4 do not extend to the bottom of the wellbore 12. Thus, the tubular string 11 will be run against an open hole wall in the final horizontal portion of the wellbore 12.

The tubular string 11, such as a casing or liner string, is run into the wellbore 12 by conventional means until a first location is reached or is run as deep as possible. When the tubular string 11 stops moving down under its own weight (or reaches the first location), additional weight is added at the surface by removably attaching a weighting assembly 13, such as a retrievable bridge plug 14, to the tubular string near the surface 5. Other weighting implements include smaller diameter drill pipe 15 hung in the tubular string 11, such as Hevi-wate drill pipe sections, and pipe collars hung on the plug 14. Pipe 15 hung on plug 14 may also contain a dense fluid for weighting purposes. Other means of attaching the weighting implements to the tubular string 11 besides a retrievable bridge plug include a running drill collar or a storm plug.

Figure 5:
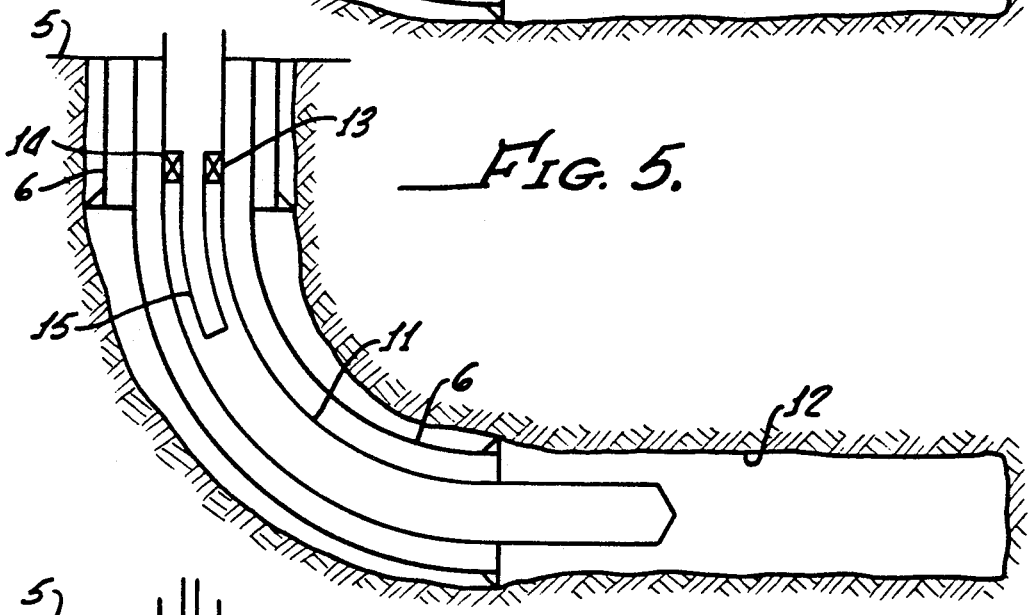
FIG. 5 shows a schematic view of the tubular string shown in FIG. 4 after a weighting implement has been run into the well.
Figure 6:
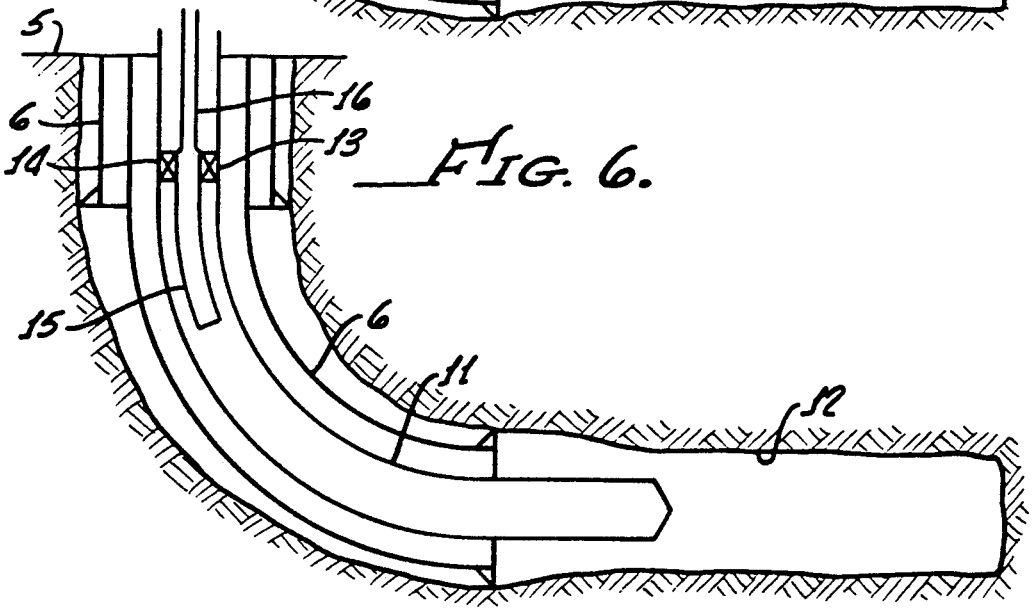
FIG. 6 shows a schematic view of the retrieval of the weighting implement shown in FIG. 5.

The weighting mechanism 13 attached to the tubular string 11 and the added weight attached to or hung from the string 11 or weighting mechanism 13 again provide added downward force to drive the lower end of the tubular string 11 further towards the bottom of the wellbore 12, as shown in FIG. 5. As the increasingly-long tubular string 11 runs into the wellbore 12, the weighting mechanism and added weight begin to turn into the non-vertical or transition portion of the well towards the horizontal portion. This change in orientation causes a decrease in driving force and an increased drag tending to resist running into the wellbore 12. At the location where the tubular string 11 stops or reaches a second position as shown in FIG. 6, the weighting assembly 13 is retrieved, e.g., by tubing 16. Tubing 16 is run within the tubular string 11 and attaches to a weighting implement, such as a retrievable bridge plug 14. The bridge plug 14 is detached from the tubular (e.g., by twisting or deflating), repositioned towards the surface 5, and reattached to the tubular string at a repositioned (higher) location. This reattachment and reorientation of the weighting implements from the build section decreases drag and increases the driving force to continue running the tubular string into the well.

Similar to the repositioning of the drill pipe 7 in FIGS. 1–3, the repositioning of the bridge plug 13 shown in FIGS. 4–6 can be repeated as many times as necessary. When the tubular string is located in its final position, the bridge plug 13 (and any added implements or weight attached to the plug) is removed and the liner set in place.

Figure 7:
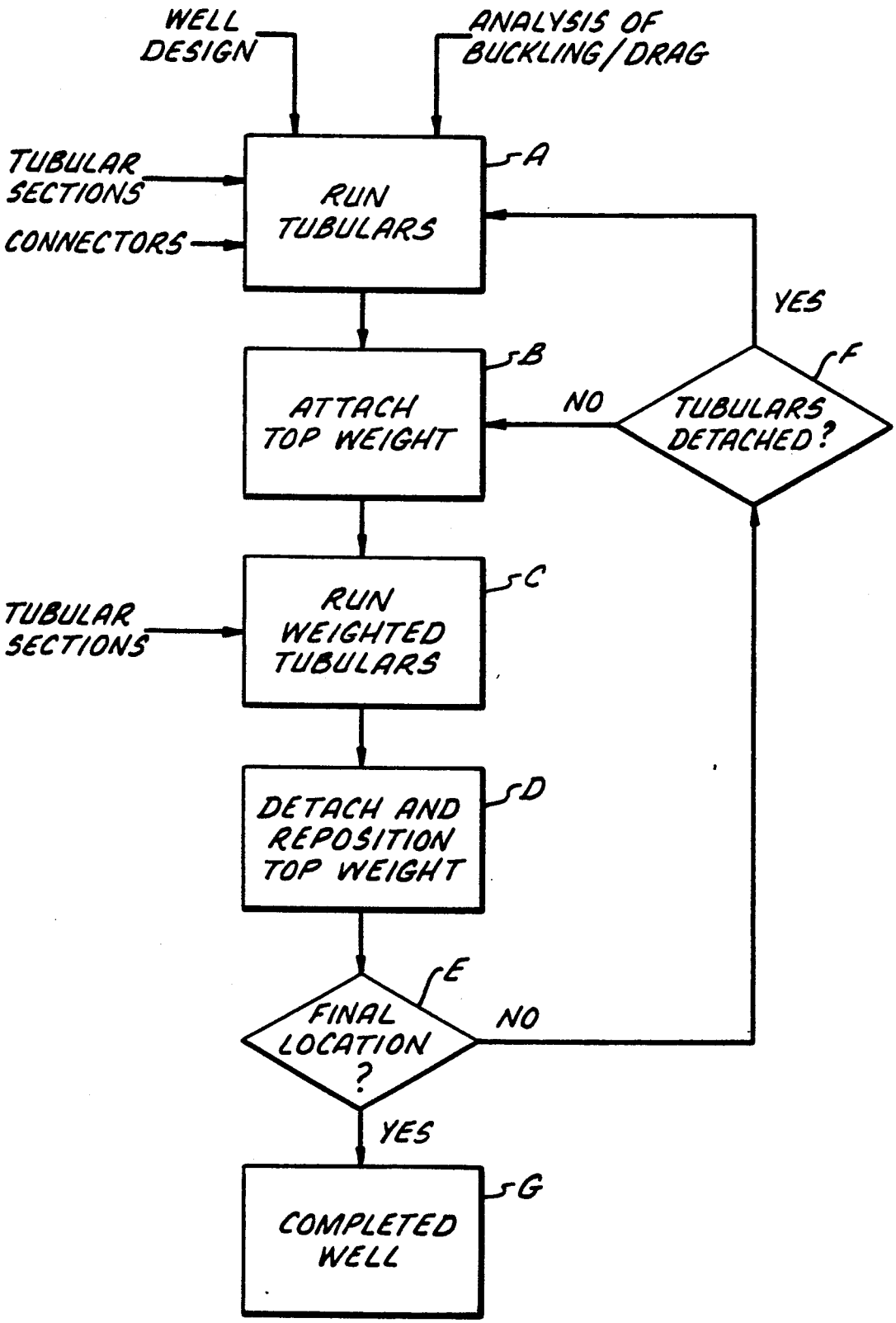
FIG. 7 is a process flow diagram of a combined weight repositioning process.

FIG. 7 is a process flow schematic combining the methods shown in FIGS. 1–3 and FIGS. 4–6. Step A runs tubulars into the well. Tubular sections are combined to form the tubular string or tubulars run within the well as planned by design and analysis methods. The tubulars run at Step A may be the first tubulars run into the well or later-run tubulars which may attach to tubulars which preexist in the well. If tubulars being run must be connected to pre-existing tubulars run, a connection device is also provided with the tubulars being run.

Step B attaches a top weight to the tubulars run into the well from step A. A variety of top weights may be used, including heavier weight tubulars (attached to the top of the tubulars already run into the well), heavy drill pipe, drill collars, dense fluid retaining containers, and attachable plugs or latches.

Step C runs the top weighted tubular string from step B further into the well. Running again requires additional tubular sections to be added to the string. Running continues until a predetermined length (e.g., as planned in the well design supplied in Step A), a data point indicates high drag (such as low indicator weight) or other unwanted condition, or a stuck tubular is achieved.

Step D detaches and repositions the "top weight." Because additional tubular sections have been attached and run into the well, at least portion of the "top weight" attached at step B has now been lowered into the well. Detachment of the "top weight" therefore occurs downhole. Detachment may be accomplished by a retrieval device, such as a latching and/or fishing tool, or (if heavy weight drill string has been used) by disconnection and raising a portion of the string.

Repositioning of the top weight is typically up well. Repositioning typically again places the weight on top of tubulars being run into the well if additional running is required.

Step E determine whether additional running is required, i.e., whether the final location has been reached. Determination may be a planned tubular length (in Step A) or it may be based upon other running or drilling data. If the final location has not been reached and tubulars have not been detached in step F, the repositioned top weight is reattached to the tubulars in step B. For wells similar to that shown in FIG. 1, the reattachment (typically near the top of the vertical portion of the well) provides additional downward force to urge the tubulars into the horizontal portion of the well. The added force allows the Steps following Step B to be repeated until a final location is reached.

If the final location has been reached at step E, the well is completed in step G. Completion may include attaching the tubulars in place, removing portions of the tubulars, or cementing the tubulars.

The amount of weight attached to the tubular string at step B can be calculated using known predictive drag and buckling methods. The amount of weight must be sufficient to overcome drag forces during running step C, but not so great so as to buckle or otherwise damage the string. An example of a predictive technique is disclosed in an OTC paper #6224 entitled "Extended Reach Drilling From Platform Irene," by Mueller et al., presented to the 1990 Annual Offshore Technology Conference on May 7–10, 1990, and the teachings of which are herein incorporated by reference. Other limitations on the amount of weight include drilling rig capabilities and tubular attachment mechanism strength limitations.

The weight repositioning method produces several advantages. Most importantly, it extends the reach of well drilling and completion capabilities. It does this without the need for exotic tools, i.e., using mostly conventional equipment. It also reduces or eliminates the need to rotate casing in the borehole. The maximum lateral distance or extended length of tubulars that may run outward in a highly deviated well using this method is theoretically limited only by the strength and buckling potential of the tubulars. For example, the length of the tubular string run in a well with a true vertical depth of less than 1000 feet (304.8 meters) is typically in the range of from 1500 to 4500 feet (457.2 to 1371.6 meters). Buckling is a function of the difference in diameters between the tubulars being run and the borehole (or existing casing) that the tubulars are being run in. A diameter difference of less than $\frac{1}{3}$ of the tubular diameter is preferred.

Alternative embodiments are also possible. These include: Using the detach, reposition, and reattach method with drill pipe during drilling, for example during non-rotational drilling using downhole mud motors; draining or replacing any weighting (dense) fluid downhole with a less dense fluid prior to repositioning to minimize repositioning effort; and providing a means for pulling tubulars at the lower end of the tubulars.

The invention is further described by the following example which was successfully field tested in Well OCS P-0241 #C29, Platform "C", Dos Cuadras Field, Offshore California. This well can be described as segmented, similar to others in the Dos Cuadras Field, having an upper, near vertical and straight segment with a 16 inch (approximately 40.64 cm) nominal diameter, 75 pound/ft (111.6 kg/m) K-55 casing (similar to uppermost casing 6 portion shown in FIG. 1), a build or transition section having a $10\frac{3}{4}$ inch (approximately 27.3 cm) nominal diameter, 51 pound/ft (75.9 kg/m) K-55 casing (similar to the curved casing section 6 portion shown in FIG. 1), and a $6\frac{5}{8}$ inch (approximately 16.8 cm) nominal diameter, 24 pound/ft (35.7 kg) K55 round holed liner extending in a nearly horizontal direction to the bottom (similar to the horizontal casing section 6 shown in FIG. 1). It is believed the test results are illustrative of a specific mode of practicing the invention but are not intended as limiting the scope of the invention as defined by the appended claims. The test well had a nearly vertical upper portion extending about 300 feet (91.4 meters), a transition portion extending about 900 feet (274.3 meters), and a deviated portion extending at least about 3150 feet (960.1 meters).

EXAMPLE 1

About 1901 feet (579 meters) of 6 inch (about 16.83 cm) nominal diameter round-holed liner was run into the #C29 well located in the Dos Cuadras Field until the liner ceased to run or fall into the well. Ten, $4\frac{3}{4}$ inch (about 12.1 cm) nominal diameter drill collars were then attached inside the end of the liner near the surface on a Baker Model "C" Hurricane plug. The added weight allowed the liner to run an additional approximately 627 feet (191.1 meters) until it stopped again. $2\frac{7}{8}$ inch (approximately 7.30 cm) nominal diameter tubing was used to retrieve the weighting Hurricane plug and drill collars. The weighting implements were repositioned and reattached to the liner near the surface. This again allowed the liner to run further into the well. This procedure was repeated two more times to run a total of approximately 3165 feet (964.7 meters) of liner into the wellbore. Further running to the programmed total depth of about 4380 feet (1335.0 meters) was accomplished by hanging an assortment of drill pipe, Hevi-Wate drill pipe and drill collars on a weight pipe supported by a Baker SLP liner hanger. The drill collars and other attached weighting hardware were retrieved with a liner hanger running tool and the liner was set.

Further information on the weight assisted casing running technique used for this C-29 well and other related information are disclosed in a paper entitled "Field Results of Shallow Horizontal Drilling in Unconsolidated Sands, Offshore California," by J. D. Payne, Chris Huston, and M. J. Bunyak, presented to the 34th Annual Offshore Technology Conference in Houston, Texas, May 4–7, 1992, the teachings of which are incorporated herein by reference.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A method for running a liner into a subterranean wellbore having an upper wellbore portion which is substantially oriented in a vertical direction and a lower wellbore portion which substantially deviates from a vertical direction, which method comprises:

attaching a detachable weighting implement to said liner at a first location;

running one end of said liner into said wellbore until said end is proximate to said lower portion;

detaching said weighting implement from said liner after said running; and attaching the weighting implement after detaching to said liner at a second location.

2. The method of claim 1 which after the step of second location attaching also comprises the steps of:

attaching a pipe string proximate to an upper end of said liner, said pipe string having a diameter smaller than said liner;

further running said liner, pipe string, and attached weighting implement into said wellbore;

detaching said weighting implement from said liner after said further running; and reattaching said weighting implement to said pipe string at a third location.

3. The method of claim 2 wherein said second location is proximate to said upper wellbore portion.

4. The method of claim 3 wherein said weighting implement comprises a retrievable bridge plug and said step of detaching comprises removing said bridge plug and repositioning said bridge plug towards said upper wellbore portion.

5. The method of claim 3 wherein said weighting implement comprises a snap latch connector and said step of detaching comprises disconnecting said connector.

6. A method for inserting a tubular string into a deviated cavity having an upper portion which is oriented in a substantially vertical direction and a lower portion which substantially deviates from a vertical direction, which method comprises:

attaching a detachable weighting implement to a first tubular string portion at a first location;

inserting a lower end of said first tubular string portion into said cavity and attaching a second tubular string portion to said first tubular string portion, continuing said inserting until said lower end is proximate to said lower portion of said cavity;

detaching said weighting implement from said first string portion after said inserting; and second attaching said weighting implement to said string in a second location.

7. The method of claim 6 which also comprises the following steps after said second attaching:

further inserting said string portions and attached weighting implement into said cavity;

second detaching said weighting implement from said string after said further inserting; and third attaching said weighting implement to said string at a third location.

8. The method of claim 7 wherein said cavity also contains a cavity fluid, said first tubular string portion comprises a casing string, and said weighting implement comprises a pipe collar and an attached pipe string having a diameter smaller than said casing string, wherein said attaching step also comprises at least partially filling said pipe string with a weighting fluid.

9. The method of claim 8 wherein said detaching step also comprises at least partially removing said weighting fluid from said pipe string and circulating said cavity fluid.

10. The method of claim 9 wherein at least one of said attaching steps comprises attaching said a heavy weight drill pipe section to the top of said casing string, said heavy weight drill pipe section weighing at least about 59 kg/meter.

11. The method of claim 10 wherein said detaching step also comprises disconnecting said heavy weight drill pipe from said casing string leaving said string substantially detached from the top of said cavity.

12. The method of claim 11 wherein said second attaching comprises attaching said heavy weight drill pipe to a portion of said casing string which was not in said cavity during said first detaching step.

13. The method of claim 12 which also comprises the step of repeating said attaching and detaching steps until an ultimate length of string is inserted into the cavity.

14. The method of claim 13 wherein said deviated cavity is an extended reach wellbore having a true vertical depth of no more than about 300 meters and a near vertical portion of no more than about 90 meters and wherein said ultimate length inserted into the wellbore during said inserting step is at least about 460 meters.

15. The method of claim 14 wherein at said ultimate length of said heavy drill pipe inserted during said inserting step ranges from about 460 to 1370 meters.

16. An apparatus for running first and second tubular portions into a wellbore comprising:

a weighting implement capable of being detachably connected to said first tubular portion;

means for connecting said second tubular portion to the top of said first tubular portion during said running;

means for detaching and repositioning said weighting implement when said first portion is run within said wellbore; and means for attaching said weighting implement to said second portion after said weighting implement is detached from said first portion.

17. The apparatus of claim 16 wherein said weighting implement comprises a retrievable bridge plug and an attached drill pipe.

18. The apparatus of claim 16 wherein said weighting implement comprises a drill collar and a storm plug.

19. The apparatus of claim 17 wherein said means for detaching and said means for attaching comprise tubing extending from proximate to the top of said wellbore to said weighting implement when contained within said first tubular portion, said tubing releasably attachable to said weighting implement.

20. The apparatus of claim 19 wherein said means for connecting is a release tool.

21. The apparatus of claim 20 wherein said release tool is capable of retaining a first fluid within said second tubular portion and capable of flowing a second fluid from said first to said second tubular portions.

* * * * *